US007427829B2

(12) United States Patent
Deme et al.

(10) Patent No.: US 7,427,829 B2
(45) Date of Patent: Sep. 23, 2008

(54) FLUORESCENT LAMP HAVING IMPROVED BARRIER LAYER

(75) Inventors: Istvan Deme, Budapest (HU); Judit Szigeti, Budapest (HU); Gábor Sajó, Budapest (HU)

(73) Assignee: General Electric Company, Schenectady, NY (US)

( * ) Notice: Subject to any disclaimer, the term of this patent is extended or adjusted under 35 U.S.C. 154(b) by 128 days.

(21) Appl. No.: 11/257,569

(22) Filed: Oct. 25, 2005

(65) Prior Publication Data

US 2007/0090765 A1 Apr. 26, 2007

(51) Int. Cl.
*H01J 1/62* (2006.01)
*H01J 63/04* (2006.01)

(52) U.S. Cl. ..... 313/485; 313/484; 313/489; 313/635

(58) Field of Classification Search ..... 313/635, 313/636, 639, 567, 484, 485, 489
See application file for complete search history.

(56) References Cited

U.S. PATENT DOCUMENTS 5,268,614 A * 12/1993 Labib et al. ..... 313/486
5,539,277 A * 7/1996 Jansma ..... 313/489
5,602,444 A 2/1997 Jansma
5,614,783 A * 3/1997 Fujino ..... 313/485
5,619,096 A 4/1997 Kaliszewski et al.
5,666,027 A * 9/1997 Jaspers ..... 313/635
5,753,999 A 5/1998 Roozekrans et al.
6,174,213 B1 * 1/2001 Paz de Araujo et al. ..... 445/58
6,369,502 B1 * 4/2002 Auber et al. ..... 313/489
6,417,614 B1 * 7/2002 Ronda et al. ..... 313/485
6,713,950 B2 * 3/2004 Soules et al. ..... 313/346 R
6,774,557 B2 8/2004 Jansma
6,952,081 B1 10/2005 Jansma
2003/0006695 A1 * 1/2003 Jansma ..... 313/489
2004/0113537 A1 * 6/2004 Srivastava et al. ..... 313/486
2004/0224189 A1 11/2004 Jansma
2006/0103315 A1 5/2006 Vossen et al.

FOREIGN PATENT DOCUMENTS

EP 1 274 119 A2 1/2003
WO WO 2004/013892 A2 2/2004

* cited by examiner

*Primary Examiner*—Joseph L. Williams
*Assistant Examiner*—Kevin Quarterman
(74) *Attorney, Agent, or Firm*—Pearne & Gordon LLP

(57) ABSTRACT

A mercury vapor discharge fluorescent lamp having a barrier layer and a phosphor layer. The barrier layer comprises yttria-coated alumina particles. The barrier layer is preferably at least 11 weight percent yttria. Preferably the yttrium-coated alumina particles are provided in an aqueous suspension and are then substantially separated from the dissolved salts therein before being combined into a coating suspension for coating the lamp.

15 Claims, 1 Drawing Sheet

FLUORESCENT LAMP HAVING IMPROVED BARRIER LAYER

FIELD OF THE INVENTION

The present invention relates generally to fluorescent lamps and more particularly to a fluorescent lamp having an improved barrier layer.

DESCRIPTION OF RELATED ART

Fluorescent lamps and their operation are well known in the art. Fluorescent lamps utilize an electric discharge to excite mercury vapor to produce ultraviolet light, which causes a phosphor layer deposited on or over the inner surface of a glass envelope to fluoresce and emit visible light. Unfortunately, the mercury vapor over time reacts with the phosphor particles and with the glass envelope and becomes depleted. As the quantity of mercury becomes depleted, the lumen output of the lamp decreases.

One solution to this problem has been to provide a barrier layer of alumina, silica or yttria between the phosphor layer and the inner surface of the glass envelope to protect the glass from reaction with mercury. Yttria barrier layers are typically not used because of cost. Further, high purity yttria of different particle sizes is not abundant commercially. A barrier layer is also useful to reflect UV radiation which has passed through the phosphor layer back into the phosphor layer. Accordingly, there is a need for an improved barrier layer that protects the glass envelope from reaction with mercury and which effectively reflects ultraviolet light back into the phosphor layer.

SUMMARY OF THE INVENTION

A mercury vapor discharge fluorescent lamp is provided comprising a light-transmissive envelope having an inner surface, means for providing a discharge, a discharge-sustaining fill sealed inside said envelope, a phosphor layer inside the envelope and adjacent the inner surface of the envelope, and a barrier layer between the envelope and the phosphor layer. The barrier layer comprises yttria-coated substrate particles, the barrier layer being at least 11 weight percent yttria. The barrier layer is provided by a process comprising the steps of providing yttrium-coated substrate particles in an aqueous suspension, separating the particles from at least 50 weight percent of the dissolved salts in the suspension, thereafter combining the particles into a coating suspension, thereafter coating the coating suspension inside the envelope and thereafter forming the barrier layer therefrom.

DETAILED DESCRIPTION OF THE PREFERRED EMBODIMENTS OF THE INVENTION

Figure 1:
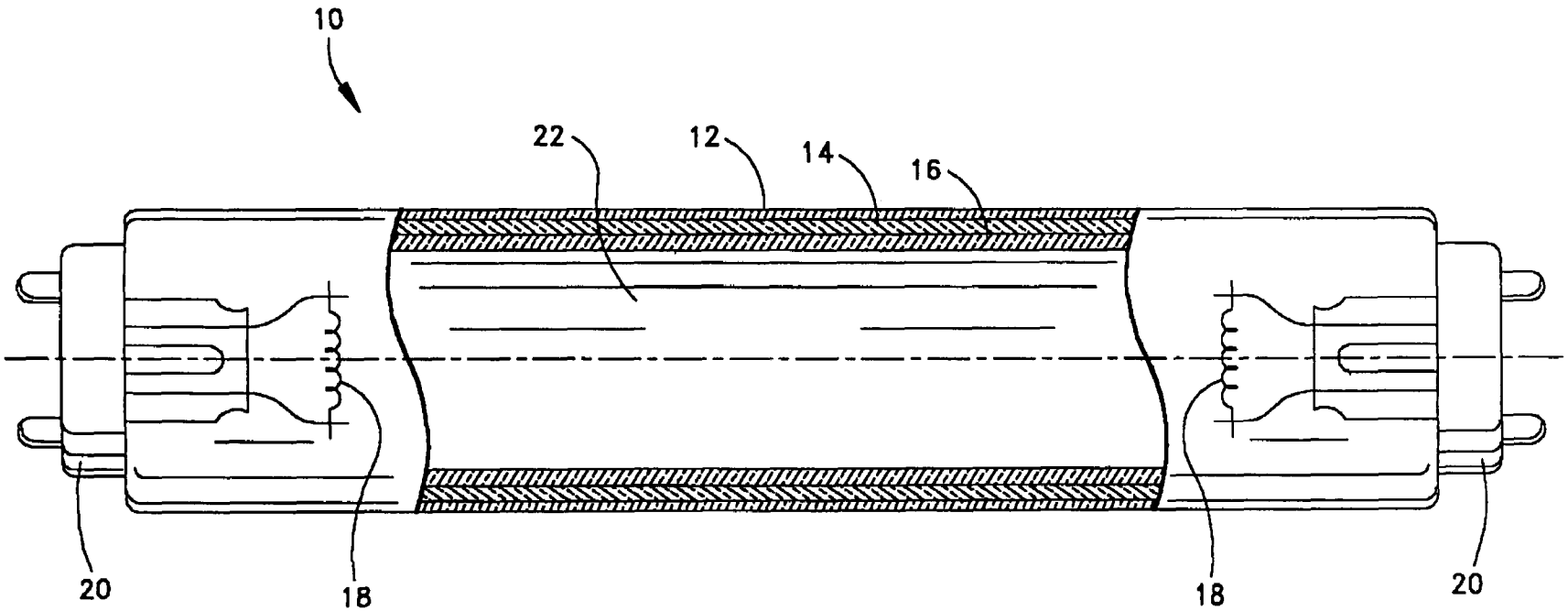
FIG. 1 shows diagrammatically, and partially in section, a fluorescent lamp according to the present invention.

In the description that follows, when a preferred range, such as 5 to 25 (or 5-25), is given, this means preferably at least 5 and, separately and independently, preferably not more than 25.

As used herein, a "fluorescent lamp" is any mercury vapor discharge fluorescent lamp as known in the art, including fluorescent lamps having electrodes, and electrodeless fluorescent lamps where the means for providing a discharge includes a radio transmitter adapted to excite mercury vapor atoms via transmission of an electromagnetic signal. The contents of U.S. Pat. Nos. 5,602,444, 6,952,081 and 6,774,557 are incorporated herein by reference in their entirety. Also as used herein, a "T8 lamp" is a fluorescent lamp as known in the art, preferably linear, preferably nominally 48 inches in length, and having a nominal outer diameter of 1 inch (eight times ⅛ inch, which is where the "8" in "T8" comes from). Less preferably, the T8 fluorescent lamp can be nominally 2, 3, 6 or 8 feet long, less preferably some other length. Other fluorescent lamps capable of utilizing the present invention include, but are not limited to, T12, T10 and T5 lamps, preferably linear, and compact, 2D, spiral, electrodeless lamps, etc.

With reference to FIG. 1, there is shown a representative low pressure mercury vapor discharge fluorescent lamp 10, which is generally well-known in the art. The fluorescent lamp 10 has a light-transmissive glass tube or envelope 12 that has a circular cross section. Though the lamp in FIG. 1 is linear, the invention may be used in lamps of any shape and any cross section. The inner surface of the envelope 12 is provided with an ultraviolet reflecting barrier layer 14 according to the present invention. The inner surface of the barrier layer 14 is provided with a phosphor layer 16, the barrier layer 14 being between the envelope 12 and the phosphor layer 16. Phosphor layer 16 is as known in the art and preferably has a coating weight of 1-5 mg/cm$^2$. Phosphor layer 16 is preferably a rare earth phosphor layer, such as a rare earth triphosphor layer, but it may also be a halophosphate phosphor layer or any other phosphor layer or layers as known in the art that absorbs ultraviolet light.

Optionally, other layers may be provided inside the envelope 12; for example, adjacent to or between the layers 14 and 16, such as for example multiple phosphor layers may be provided, for example a halophosphate phosphor layer may be provided between the barrier layer and a rare earth triphosphor layer.

The fluorescent lamp 10 is hermetically sealed by bases 20 attached at both ends and electrodes or electrode structures 18 (to provide an arc discharge) are respectively mounted on the bases 20. The pair of spaced electrodes is a means for providing a discharge. A discharge-sustaining fill 22 is provided inside the sealed glass envelope, the fill being typically an inert gas such as argon or a mixture of argon and other noble gases such as krypton at a low pressure in combination with a small quantity of mercury to provide the low vapor pressure manner of lamp operation.

The invented barrier layer is preferably utilized in a low pressure mercury vapor discharge lamp, but may less preferably be used in a high pressure mercury vapor discharge lamp. The invented barrier layer may be used in fluorescent lamps having electrodes as is known in the art, as well as in electrodeless fluorescent lamps as are known in the art, where the means for providing a discharge is a structure which provides high frequency electromagnetic energy or radiation.

The barrier layer 14 of the present invention more effectively reflects ultraviolet light back into the phosphor layer 16, or multiple phosphor layers if present, where it may be utilized and emitted as visible light, thus leading to improved phosphor utilization and more efficient production of visible light. This is particularly important where the phosphor layer is thinner and more UV radiation passes through. Lamps with the invented barrier layer can require lower quantities of mercury (since less is consumed), have lower UV emission, provide greater lumen output, provide comparable lumen output with less phosphors, require a thinner barrier layer with comparable performance, and more effectively protect the glass from reaction with mercury.

The invented barrier layer 14 contains particles of alumina coated with yttria. It is to be understood that the yttria- or yttrium-coated alumina particles are formed prior to being added to a solution of deionized water, surfactant and/or other additives (i.e. the coating suspension) that is used to coat the inner surface of the glass envelope. As such, most or all of the dissolved salts and/or by products and/or impurities formed or present during the coating of the alumina particles with yttria or yttrium, can be removed before the yttria- or yttrium-coated alumina particles are added to the coating suspension. As a result, the coating suspension is sufficiently or substantially or materially or effectively or essentially free of impurities. Also, this method results in less restrictions regarding alumina particle size, amount of yttria, binder and additives of the coating suspension, and the coating/drying process, as mentioned below.

Coating the alumina particles prior to adding them to the coating suspension increases the particle size range of alumina particles that can be utilized. Larger particles of alumina would likely not be sufficiently coated in a coating suspension if yttria or a yttrium salt was added because of the presence of other components, such as binders, surfactants, additive, etc. As such, coating the alumina particles prior to adding them to the coating suspension ensures more uniform coating of the surface of the particles. Furthermore, alumina particles of various sizes can be uniformly coated by the method as described below.

Another advantage of coating the alumina particles prior to adding them to the coating suspension is the amount of yttria that can be used in the barrier layer. If yttrium salt is added to the coating suspension in order to coat the alumina particles, the water content of the coating suspension significantly limits the amount of yttrium salt soluble in the suspension. Additionally, certain binders or surfactants used in the coating suspension may be incompatible with the yttrium salt being used.

The barrier layer in the finished lamp preferably has a coating weight of 0.05-3, more preferably 0.1-1, more preferably 0.3-1, mg/cm$^2$. The alumina particles in the barrier layer preferably have a deagglomerated median particle diameter or size of 10-6000, more preferably 50-2500, more preferably 100-1200, more preferably 180-700, more preferably 240-480, more preferably 270-440, nm, and a specific surface area of 0.3-800, more preferably 0.8-300, more preferably 2-120, more preferably 4-70, more preferably 6-50, more preferably 7-40, m$^2$/g.

The barrier layer contains preferably 1-35, preferably 1-30, preferably 5-25, preferably 8-22, preferably 10-20, preferably at least 11, 12, 13, 15 or 16, weight percent yttria, with the balance being preferably alumina particles. In another preferred embodiment, when alumina having a specific surface area of 30-50 m$^2$/g is utilized in the barrier layer, the barrier layer 14 preferably comprises 1-20, preferably 5-15, preferably 8-12 and more preferably about 10, weight percent yttria, with the balance being alumina. Further, when alumina having a specific surface area of 80-120 m$^2$/g is utilized, the barrier layer 14 preferably comprises 10-40, preferably 12-30, preferably 15-25, preferably 18-22, and more preferably about 20, weight percent yttria, with the balance being alumina. As can be seen, the smaller the alumina particles, the greater is the specific surface area and the greater the weight percent of yttria.

The coating of yttria is provided over the alumina particles as follows. The alumina particles, often in the form of a powder, are first dispersed in water, preferably deionized water. Preferably, the alumina powder is 10-30 percent by weight of the deionized water and alumina mixture. Next, an yttrium salt is added to the mixture at a rate of 3-30 yttrium atoms per nm$^2$ of alumina surface. Preferred yttrium salts are yttrium chloride and yttrium nitrate, though any water-soluble organic, or inorganic yttrium salt can be used. Most preferably, a yttrium nitrate solution containing about 3-30 yttrium atoms per nm$^2$ of alumina surface is added to the mixture. The mixture is stirred, agitated or sonicated until the alumina particles are completely dispersed in the water/yttrium nitrate suspension. At this point, no coarse aggregates of alumina powder should exist in the suspension.

Crystalline urea is then added at a rate of 2-40 or 3-30 or 5-20 times the molar amount of yttrium previously added. The suspension is continuously stirred, agitated or sonicated and heated to a temperature of preferably 70-90° C., more preferably to about 85° C. and kept at that temperature for about an hour. In this way the yttrium solution becomes saturated or supersaturated to yield yttrium hydroxy carbonate. The growth of yttrium hydroxy carbonate increases at elevated temperatures because the urea decomposes and offers carbonating ions above 60° C. The homogenous and gradual increase of pH and CO2 concentration and the presence of the alumina surface make heterogeneous nucleation more favorable. As a result, yttrium hydroxy carbonate is deposited or precipitated onto the surface of the alumina particles in the form of a shell or coating believed to be a few nanometers thick.

The suspension is then allowed to gradually cool down to ambient temperature, preferably between 20-25° C. Sufficient ammonium hydroxide is then added to bring the pH of the suspension to over 7, preferably to about 8 or above. Typically no more coarse precipitation of yttrium occurs, indicating that there was no appreciable amount of yttrium ions left in the solution after the heating in the presence of urea. The remaining dissolved salts or other impurities present in the suspension are significantly reduced or eliminated by centrifugation and/or filtration and/or washing the yttrium-coated alumina particles with deionized water. Preferably the yttrium-coated alumina particles in the aqueous suspension are separated from at least 50, 60, 70, 75, 80, 90, 95, 98, 99, or 99.9, weight percent of the dissolved salts in the suspension via centrifugation and/or filtration and/or washing and/or other techniques known in the art. The separated or washed particles can be dried, baked or milled. Baking the yttrium-coated alumina particles converts the yttrium to yttrium oxide, or yttria, thus yielding yttria-coated alumina particles. Alternatively the separated particles can be used as a wet cake for preparing the coating suspension used to coat the barrier layer on the inner surface of the glass envelope.

To prepare the barrier layer on the glass envelope, the baked and milled yttria-coated alumina particles, or the wet cake, is dispersed in deionized water and surfactants and other additives are added as are necessary to form a smooth coating of the desired thickness in the glass envelope. Suitable surfactants include, but are not limited to, Pluronic F108 and Igepal CO-530. Pluronic F108 is a block copolymer surfactant mixture of polyoxyethylene and polyoxypropylene available from BASF. Igepal CO-530 is a nonylphenol ethoxylate and is available from Rhodia. Preferred thickeners are nonionic, water soluble polymeric thickeners such as polyethylene oxide. The coating suspension is then coated on the inner surface of the glass envelope 12 by known coating means. After the barrier coating suspension is sufficiently dried, a suitable phosphor suspension formulation and coating technique can be used to provide the phosphor layer over the barrier layer.

After the barrier layer and the phosphor layer or layers have been coated and dried, the coated glass envelope is baked by conventional means using the highest temperature the glass material allows (usually over 400° C. or 500° C. or 600° C. for at least 30 seconds, preferably 0.5-10 min). The organic and volatile inorganic content of the coatings evaporates and pyrolizes and is carried away by hot air blown through the tube. Any unoxidized yttrium coating on the alumina particles is usually and preferably oxidized to yttrium oxide or yttria. As a result, the glass envelope has two inorganic layers with yttria-coated alumina particles in the barrier layer and phosphor particles in the phosphor layer. The lamp manufacture is then completed in the usual way.

In order to promote a further understanding of the invention, the following examples are provided. These examples are shown by way of illustration and not limitation.

EXAMPLE

Three lamps were constructed, each one being a 4000K color temperature 36 W 26 mm ID linear fluorescent lamp filled with 75% Kr and 25% Ar at 1.7 torr pressure. Each lamp utilized a rare earth triphosphor blend having commercial Eu (III) activated $Y_2O_3$ (YEO red), Ce, Tb activated $LaPO_4$ (LAP green) and Eu (II) activated Ba, Mg aluminate (BAM blue) phosphors. Each lamp had a barrier layer between the glass envelope and the phosphor layer. Lamp 1 had a yttria-coated alumina particle barrier layer according to the invention. The barrier layer suspension coating for Lamp 1 was prepared by first dispersing 100 g of Ceralox APA 0.2 commercial grade high purity (99.96%) alumina with a specific surface area of 40 $m^2/g$ and a deagglomerated median particle diameter of 270 nm in 350 g of deionized water. Next, 50 ml of 2M yttrium nitrate solution was added and the suspension was stirred until no coarse aggregates were present. 50 g of urea was added and the suspension was gradually heated to 85° C. within one hour. The suspension was maintained at 85° C. for another hour and then allowed to cool to ambient temperature, at which point 10-20 ml of $NH_3$ solution was added to bring the pH to about 8. There were no signs of additional precipitation of yttrium, thus indicating the completion of yttrium precipitation during the prior stages. The yttrium-coated alumina particles were separated by centrifugation and then added to 500 ml of deionized water for washing. The particles were centrifuged again and again suspended in 500 ml deionized water. Then enough deionized water was added to bring the volume up to 1 liter. Barrier coating was done with this suspension after adding a suitable surfactant (e.g. 0.1 g Igepal CO-530). After the phosphor layer was added the glass envelope was baked as described above to yield yttria-coated alumina particles in the barrier layer.

Lamp 2 was the same as Lamp 1, except it had a conventional alumina particle barrier layer using 75 weight percent Ceralox APA 8AF high purity (99.87%) alumina, being a commercial pure alpha grade of specific surface area of 7 $m^2/g$ and deagglomerated median particle diameter of 440 nm, and 25 weight percent of Ceralox APA 0.2.

Lamp 3 was the same as Lamp 2, except its barrier layer was 100 weight percent Ceralox APA 0.2.

The results of the three lamps are as follows. Weights are averages with range width of +/−3%. Numbers in parenthesis are standard deviations of six samples.

TABLE 1

| | Lamp 1 | Lamp 2 | Lamp 3 |
|---|---|---|---|
| Barrier Layer Composition | Yttria-coated Ceralox APA 0.2 | Ceralox APA 8AF and Ceralox APA 0.2 | Ceralox APA 0.2 |
| Barrier Layer Weight (g) | 0.25 | 0.56 | 0.32 |
| Phosphor Layer Weight (g) | 1.71 | 1.72 | 1.70 |
| 100 hour lumen output | 3390 (26) | 3346 (18) | 3328 (24) |
| 500 hour lumen output | 3324 (21) | 3264 (24) | 3270 (20) |

As can be seen above, Lamp 1 containing the ytrria-coated alumina particles in the barrier layer produced lumen output at 100 and 500 hours above that of Lamps 2 and 3 despite having a barrier layer weight less than Lamps 2 and 3. As can be seen, the invented barrier layer outperforms conventional alumina barrier layers. These results were both surprising and unexpected.

While the invention has been described with reference to a preferred embodiment, it will be understood by those skilled in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mercury vapor discharge fluorescent lamp comprising a light-transmissive envelope having an inner surface, means for providing a discharge, a discharge-sustaining fill sealed inside said envelope, a phosphor layer inside the envelope and adjacent the inner surface of the envelope, and a barrier layer between the envelope and the phosphor layer, said barrier layer comprising substrate particles being individually coated with a yttria shell, said yttria shells being at least 11 weight percent of said barrier layer.

2. The lamp of claim 1, said substrate particles being alumina particles, said barrier layer being 11-35 weight percent yttria.

3. The lamp of claim 2, said yttria shell being substantially uniformly coated on said alumina particles.

4. The lamp of claim 2, said barrier layer being 11-22 weight percent yttria.

5. The lamp of claim 2, said barrier layer being 15-25 weight percent yttria.

6. The lamp of claim 2, said barrier layer being present in a coating weight of 0.05-3 $mg/cm^2$.

7. A mercury vapor discharge fluorescent lamp comprising a light-transmissive envelope having an inner surface, means for providing a discharge, a discharge-sustaining fill sealed inside said envelope, a phosphor layer inside the envelope and adjacent the inner surface of the envelope, and a barrier layer between the envelope and the phosphor layer, said barrier layer being provided by a process comprising the following steps: providing yttrium-coated substrate particles in an aqueous suspension, separating said particles from at least 50 weight percent of the dissolved salts in said suspension, baking the yttrium-coated substrate particles to convert said yttrium to yttria to form substrate particles being individually coated with a yttria shell, thereafter combining said particles having a yttria shell into a coating suspension, thereafter coating said coating suspension inside said envelope and thereafter forming said barrier layer therefrom, said yttria shells being at least 11 weight percent of said barrier layer.

8. The lamp of claim 7, wherein said particles are separated from at least 75 weight percent of the dissolved salts in said suspension.

9. The lamp of claim 7, wherein said particles are separated from at least 50 weight percent of the dissolved salts in said suspension via one or more of centrifugation, washing and filtration.

10. The lamp of claim 7, wherein said particles are substantially separated from said suspension such that said particles form wet cake.

11. The lamp of claim 7, said process comprising the following step: providing yttrium-coated substrate particles in the aqueous suspension by depositing yttrium hydroxy carbonate on the surface of alumina particles.

12. The lamp of claim 7, said step of providing yttrium-coated substrate particles in an aqueous suspension being preceded by a step of providing alumina powder, yttrium ions and urea in an aqueous medium.

13. The lamp of claim 12, said urea being present in said aqueous medium at a rate of 2-40 times the molar amount of yttrium.

14. The lamp of claim 12, wherein, subsequent to said alumina powder, yttrium ions and urea being provided in said aqueous medium, the pH of said aqueous medium is raised to over 7.

15. The lamp of claim 7, wherein the substrate particles are alumina particles.

* * * * *